US006647219B2

(12) United States Patent
Buettner

(10) Patent No.: US 6,647,219 B2
(45) Date of Patent: Nov. 11, 2003

(54) ELECTROPHOTOGRAPHIC RECORDING PROCESS CONTROL METHOD AND APPARATUS

(75) Inventor: Albert V. Buettner, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/235,772

(22) Filed: Sep. 5, 2002

(65) Prior Publication Data

US 2003/0049038 A1 Mar. 13, 2003

Related U.S. Application Data

(60) Provisional application No. 60/317,614, filed on Sep. 5, 2001.

(51) Int. Cl.[7] ..... G03G 15/00

(52) U.S. Cl. ..... 399/48; 399/49; 399/50; 399/51; 399/53; 399/55; 399/56

(58) Field of Search ..... 399/48, 49, 46, 399/50, 51, 53, 55, 56

(56) References Cited

U.S. PATENT DOCUMENTS 6,006,047 A * 12/1999 Mara et al. ..... 399/49

6,034,703 A * 3/2000 Broddin et al. ..... 347/131

FOREIGN PATENT DOCUMENTS

JP 63-205670 * 8/1988

* cited by examiner

*Primary Examiner*—Hoang Ngo

(57) ABSTRACT

The surface of an electrostatic recording member in an electrophotographic recording apparatus is charged to a standard primary charge $V_{0s}$. The standard primary charge on the recording member is then modulated using a first test exposure $E_1$ to form a first exposed test area, and using a second test exposure $E_2$ to form a second exposed test area. A first test surface potential $V_1$ is measured in the first exposed test area and a second test surface potential $V_2$ is measured in the second exposed test area. A measured intrinsic sensitivity $b_m$ associated with the recording member is calculated using $V_1$ and $V_2$. A measured intrinsic toe $d_m$ associated with the recording member also is calculated using $V_1$ and $V_2$. A corrective charge parameter $V_{0i}$ is calculated using $d_m$, and a corrective exposure parameter $E_{0i}$ is calculated using $b_m$ and $d_m$. $V_0$ is then adjusted to equal $V_{0i}$, and $E_0$ is adjusted to equal $E_{0i}$.

20 Claims, 6 Drawing Sheets

ELECTROPHOTOGRAPHIC RECORDING PROCESS CONTROL METHOD AND APPARATUS

RELATED APPLICATIONS

Applicants hereby claim priority under 35 U.S.C. §119(e) to provisional U.S. patent application Ser. No. 60/317,614, filed on Sep. 5, 2001, and incorporated herein by reference.

BACKGROUND OF THE INVENTION

This invention relates to electrophotographic document copiers and/or printers and more particularly to automatic adjustment of parameters influencing reproduction by such copiers or printers.

In typical commercial electrophotographic reproduction apparatus (copier/duplicators, printers, or the like), a latent image charge pattern is formed on a uniformly charged, charge-retentive, photoconductive recording member. Pigmented marking particles are attracted to the latent image charge pattern at a developing station to develop such image on the recording member. A receiver member, such as a sheet of paper, transparency or other medium, is then brought into contact with the recording member, and an electric field applied to transfer the marking particle developed image to the receiver member from the recording member. After transfer, the receiver member bearing the transferred image is transported away from the recording member, and the image is fixed (fused) to the receiver member by heat and pressure to form a permanent reproduction thereon.

The contrast density and color balance (in color machines) of electrophotographic reproduction apparatus frequently vary depending on a variety of factors. Some of these factors, such as the sensitometry of the recording member, are intrinsic to the recording apparatus. Other factors, such as the ambient humidity and the charge density of the marking particles, are extrinsic to the reproduction apparatus.

To compensate for these factors, the contrast density and color balance of a copier or printer can be adjusted by changing certain process control parameters such as primary voltage $V_0$ and global exposure $E_0$. Control of such parameters is often based on measurements of the density of a marking particle image in a test patch. Typically, the test patch can be recorded on an area of the electrostatic recording member between adjacent image frames and developed. The developed density of the patch can be measured and adjustments made accordingly.

Existing methods and apparatus for adjusting $V_0$ and $E_0$ are limited in that they attempt to adjust for all factors affecting contrast density and color balance collectively. Compensating for all factors collectively is complicated because the separate effects of the various factors are confounded, and therefore it is difficult to achieve extremely low margins of error. Accordingly, there is a need for a method and apparatus for adjusting $V_0$ and $E_0$ that isolate variations in contrast density and color balance that are caused by different factors so that corrections can be made for independent factors independently.

Many existing methods and apparatus are also limited in that they require an iterative process to adjust $V_0$ and $E_0$ to acceptable levels, thereby expending substantial amounts of time and marking particles during the adjustment process. Accordingly, there is a need for a method and apparatus for adjusting $V_0$ and $E_0$ in which the corrective changes are not iterative.

Current high-speed reproduction apparatus place a further limitation on process control methods for adjusting $V_0$ and $E_0$. The high-speed nature of typical reproduction apparatus requires on-board corrective calculations that can be performed quickly during reproduction. This precludes the real-time resolution of transcendental equations to adjust $V_0$ and $E_0$ because the necessary calculations require too much time. Accordingly, there is a need for a method and apparatus for adjusting $V_0$ and $E_0$ that includes linear equations for calculating corrective changes.

It is therefore an object of the present invention to provide a process control method and apparatus that isolates variations in the sensitometry of the recording member and compensates for these variations. It is also an object of this invention to provide a process control method and apparatus that compensates for variations in the sensitometry of the recording member without requiring iterative corrective changes to $V_0$ and $E_0$. It is yet another object of this invention to provide a process control method and apparatus in which any necessary real-time calculations for corrective changes to $V_0$ and $E_0$ are based on linear equations.

BRIEF SUMMARY OF THE PREFERRED EMBODIMENTS

In accordance with the present invention, an improved electrophotographic recording process control method and apparatus are provided.

According to one aspect of the present invention, an electrophotographic reproduction apparatus is provided. The reproduction apparatus includes an electrostatic recording member for supporting an electrostatic image. A charging station is provided for establishing a primary charge on the recording member, the primary charge being defined by a parameter $V_0$. An exposing station having an exposure parameter $E_0$ modulates the primary charge to form an electrostatic image on the recording member. A measuring device measures an exposed surface potential of the recording member after modulation by the exposing means. A controller adjusts the parameters $V_0$ and $E_0$ by directing the charging station to establish a standard primary charge $V_{0S}$ on the recording member, directing the exposing station to modulate the primary charge to form a first electrostatic control patch using a first test exposure level $E_1$ and a second electrostatic control patch using a second test exposure $E_2$. The controller also directs the measuring device to measure a first test surface potential $V_1$ of the first control patch and a second test surface potential $V_2$ of the second control patch. The controller calculates a measured intrinsic sensitivity $b_m$ and an intrinsic toe $d_m$ associated with the recording member using $V_1$ and $V_2$. The controller also calculates a corrective charge parameter $V_{0l}$ using $d_m$, and a corrective exposure parameter, $E_{0i}$, using $b_m$ and $d_m$. The controller adjusts $V_0$ to equal $V_{0i}$, and adjusts $E_0$ to equal $E_{0i}$.

According to another aspect of the present invention, a method of controlling an electrophotographic reproduction process is provided. The surface of an electrostatic recording member in an electrophotographic recording apparatus is charged to a standard primary charge $V_{0s}$. The standard primary charge on the recording member is then modulated using a first test exposure $E_1$ to form a first exposed test area, and using a second test exposure $E_2$ to form a second exposed test area. A first test surface potential $V_1$ is measured in the first exposed test area and a second test surface potential $V_2$ is measured in the second exposed test area. A measured intrinsic sensitivity $b_m$ associated with the recording member is calculated using $V_1$ and $V_2$. A measured intrinsic toe $d_m$ associated with the recording member also is calculated using $V_1$ and $V_2$. A corrective charge parameter $V_{0i}$ is calculated using $d_m$, and a corrective exposure parameter $E_{0l}$ is calculated using $b_m$ and $d_m$. $V_0$ is then adjusted to equal $V_{0l}$, and $E_0$ is adjusted to equal $E_{0i}$.

According to yet another aspect of the present invention, a method is provided for determining a linear equation for approximating a measured intrinsic sensitivity, $b_m$, of a photoconductor charged to a primary charge, $V_0$, in an electrophotographic recording apparatus. A first exposure $E_1$, and a second exposure, $E_2$, are selected. A plurality of random sensitometric pairs, are then generated, wherein each of the random sensitometric pairs includes a random intrinsic sensitivity, $b_{rand}$, and a random intrinsic toe, $d_{rand}$. A plurality of surface potential pairs are then calculated using the plurality of random sensitometric pairs, wherein each of the surface potential pairs includes a first photoconductor surface potential, $V_1$, calculated using the first exposure, $E_1$, and a second photoconductor surface potential, $V_2$, calculated using the second exposure, $E_2$. A set of constants, $b_{m0}$, $b_{m1}$, and $b_{m2}$, are then successively approximated by using the plurality of surface potential pairs in the linear equation $b_m=b_{m0}+b_{m1}*V_1+b_{m2}*V_2$, to calculate a plurality of measured intrinsic sensitivities, $b_m$, and by and selecting $b_{m0}$, $b_{m1}$, and $b_{m2}$ to minimize the variance between the plurality of measured intrinsic sensitivities, $b_m$, and the plurality of random intrinsic sensitivities.

According to still another aspect of the present invention, a method is provided for determining a linear equation for approximating a measured intrinsic toe, $d_m$, of a photoconductor charged to a primary charge, $V_0$, in an electrophotographic recording apparatus. A first exposure $E_1$, and a second exposure, $E_2$, are selected. A plurality of random sensitometric pairs are then determined, wherein each of the random sensitometric pairs includes a random intrinsic sensitivity, $b_{rand}$, and a random intrinsic toe, $d_{rand}$. A plurality of surface potential pairs are then calculated using the plurality of random sensitometric pairs, wherein each of the surface potential pairs includes a first photoconductor surface potential, $V_1$, calculated using the first exposure, $E_1$, and a second photoconductor surface potential, $V_2$, calculated using the second exposure, $E_2$. A set of constants, $d_{m0}$, $d_{m1}$, and $d_{m2}$, is then successively approximated by using the plurality of surface potential pairs in the linear equation $d_m=d_{m0}+d_{m1}*V_1+d_{m2}*V_2$, to calculate a plurality of measured intrinsic toes, $d_m$, and selecting $d_{m0}$, $d_{m1}$, and $d_{m2}$ to minimize the variance between the plurality of measured intrinsic toes, $d_m$, and the plurality of random intrinsic toes.

The invention, and its objects and advantages, will become more apparent in the detailed description of the preferred embodiment presented below.

BRIEF DESCRIPTION OF THE DRAWINGS

The subsequent description of the preferred embodiments of the present invention refers to the attached drawings, wherein.

DETAILED DESCRIPTION OF THE PREFERRED EMBODIMENTS

The present invention is described below in the environment of a particular type of electrophotographic reproduction apparatus, such as the Nexpress 2100 digital production color press, commercially available from Nexpress Solutions LLC of Rochester, N.Y. However, it will be noted that although this invention is suitable for use with such machines, it also can be used with other types of electrophotographic copiers and printers. For instance, the invention is suitable for use with black and white reproduction apparatus such as the Digimaster 9110 Network Imaging System, commercially available from Heidelberg Digital L.L.C. of Rochester, N.Y.

Because apparatus of the general type described herein are well-known, the present description will be directed in particular to elements forming part of, or cooperating more directly with, the present invention.

Figure 1:
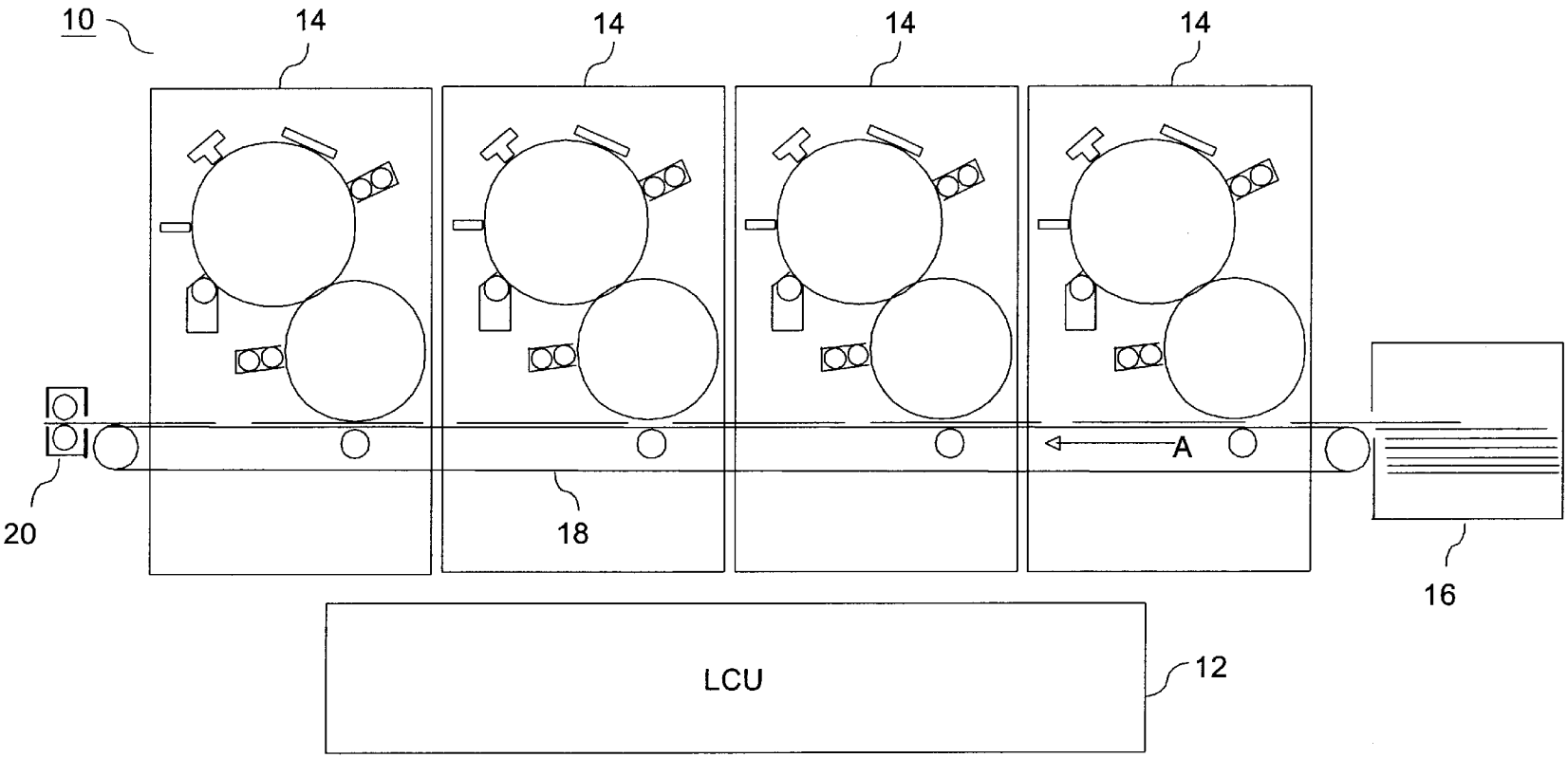
FIG. 1 shows a schematic diagram depicting an electrophotographic recording apparatus employing one presently preferred embodiment of the invention.

Referring now to the accompanying drawings, FIG. 1 schematically illustrates a typical electrophotographic reproduction apparatus 10 suitable for utilizing the method and apparatus of the present invention. The reproduction apparatus is described herein only to the extent necessary for a complete understanding of this invention. The electrophotographic reproduction apparatus 10 is under the control of a microprocessor-based logic and control unit 12 of any well known type. Based on appropriate input signals and programs supplied by software control algorithms associated with the microprocessor, the logic and control unit 12 provides signals for controlling the operation of the various functions of the reproduction apparatus for carrying out the reproduction process. The production of suitable programs for commercially available microprocessors is a conventional skill well understood in the art. The particular details of any such programs would, of course, depend upon the architecture of the designated microprocessor.

The reproduction apparatus 10 shown in FIG. 1 includes four imaging modules 14 for reproducing four component images to form a final composite color image. For example, each of the component images may contain image information relating to one of four component colors such as magenta, cyan, yellow, and black. It will be understood in the art that alternative reproduction apparatus may contain more or less imaging modules 14 for reproducing more or less component color images, as necessary. A similar reproduction apparatus for producing black and white images would include a single imaging module 14.

During reproduction, a receiver member such as a sheet of paper or transparency is transported from a receiver member source station to each of the imaging modules 14 by a transport member 18. The transport member 18 may include an endless web mounted on support rollers and movable about a closed loop path in the direction of the arrow A. At each imaging module 14, electrostatic pigmented marking particles, such as toner particles, forming the proper component image are transferred to the receiver member. After all four component images have been recorded onto the receiver member in this manner, the transport member 18 transports the receiver member to a fusing device 20 where the composite image is fixed to the receiver member by heat and/or pressure for example. The reproduction apparatus 10 then outputs the receiver member for operator retrieval.

Figure 2:
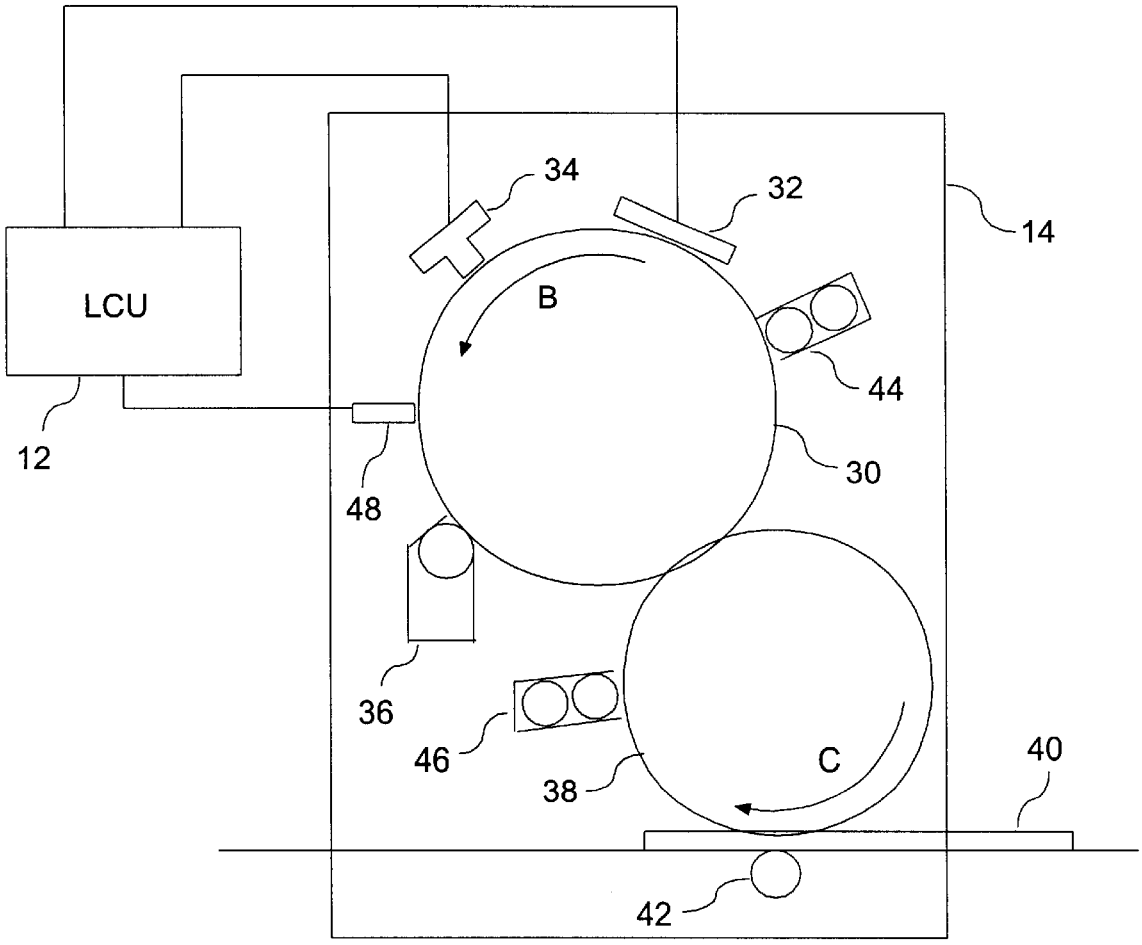
FIG. 2 shows a schematic diagram depicting in more detail one of the imaging modules shown in FIG. 1.

The operation of an individual imaging module 14 of the recording apparatus 10 will now be discussed with reference to FIG. 2. The imaging module 14 includes an electrostatic recording member 30. The recording member 30 shown in FIG. 2 is a thin photoconductive layer supported on a drum that is rotatable in the direction of arrow B. This type of recording member also may be referred to as a photoconductor or an imaging cylinder. Of course, this invention is suitable for use with other recording member configurations, such as photoconductive webs for example.

In the reproduction cycle for the imaging module 14, the rotating photoconductor 30 is uniformly charged as it moves past a charging station 32. Under the control of the logic and control unit 12, the charging station establishes a substantially uniform primary charge, $V_0$, on the photoconductor. Thereafter the uniformly charged photoconductor 30 passes an exposure station 34 where the uniform charge is altered to form a latent image charge pattern corresponding to information desired to be reproduced. Depending upon the characteristics of the photoconductor 30 and the overall reproduction system, formation of the latent image charge pattern may be accomplished by exposing the recording member 30 to a reflected light image of an original document to be reproduced, or by "writing" on the recording member 30 with a series of lamps (e.g., LED's) or scanning lasers activated by electronically generated signals based on the desired information to be reproduced. Under the control of the logic and control unit 12, the exposure station 34 typically uses a number of exposure steps based on a global exposure parameter, $E_0$, to achieve different levels of density in the developed image. In the case of LED or laser exposing elements, different exposure steps are typically achieved by varying the amount of time a particular LED or laser element is turned on during exposure. The electrical current that powers the LED's or lasers typically is constant for all exposure steps. The exposure current generally is changed only to adjust the global exposure parameter, $E_0$.

As the photoconductor 30 continues to rotate in the direction of the arrow B, the latent image charge pattern on the photoconductor 30 is brought into association with a development station 36 that applies charged pigmented marking particles to adhere to the photoconductor 30 to develop the latent image. The developing station 36 is biased with an electrical potential, $V_{bias}$, that produces an electrical field with respect to the photoconductor 30. The developing station bias is selected such that charged marking particles are attracted from the developing station 36 to the exposed areas of the photoconductor 30, but not to the unexposed areas.

The portion of the photoconductor 30 carrying the developed image then comes into contact with an intermediate transfer member 38. The intermediate transfer member 38 shown in FIG. 2 is an electrically biased drum that rotates in the direction of the arrow C and produces an electric field with respect to the recording member 30. This electric field attracts the marking particles forming the developed image from the photoconductor 30 to the intermediate transfer drum 38. As the intermediate transfer drum 38 continues to rotate in the direction of the arrow C, the transport web 18 moves a receiver member 40 to a nip formed between the intermediate transfer drum 38 and a transfer roller 42. Movement of the receiver 40 into the nip is timed to ensure proper registered relationship between the receiver 40 and the marking particles forming the developed image on the intermediate transfer drum 38. The transfer roller 42 is biased with a constant current to produce an electric field with respect to the intermediate transfer drum 38. This electric field attracts the marking particles forming the developed image from the intermediate transfer drum 38 to the receiver 40.

A photoconductor cleaning station 44 and an intermediate transfer drum cleaning station 46 also are shown in FIG. 2. The photoconductor cleaning station 44 operates to clean any residual marking particles or debris from the photoconductor 30 after the developed image is transferred to the intermediate transfer drum 38. Likewise, the intermediate transfer drum cleaning station 46 operates to clean residual marking particles and debris from the intermediate transfer drum 38 after transfer of the developed image to the receiver 40.

The imaging module 14 of FIG. 2 also includes a measuring device 48, such as an electrometer, for measuring the electrical potential of the photoconductor 30 after exposure at the exposing station 34. Test measurements of the exposed photoconductor potential are used as feedback when adjusting the process control parameters $V_0$ and $E_0$. To take a test measurement of the exposed photoconductor potential, the photoconductor is first charged to a standard primary charge $V_{0S}$ at the charging station 32. The exposing station 34 then exposes the photoconductor using a pre-determined exposure E, to form an exposed test patch. Under the control of the logic and control unit 12 the electrometer 48 measures the resulting electrical potential V in the test patch of the photoconductor.

Photodischarge and Lightness Equations

The photodischarge equation (equation 1) empirically describes the entire photodischarge curve in terms of three independent parameters associated with the photoconductor 30, the intrinsic sensitivity, b, the intrinsic contrast, c, and the intrinsic toe, d.

$$V=V_0*((1-d)*\exp(-(b*E)^c)+d) \quad (1)$$

As described above, $V_0$ is the surface potential to which the photoconductor 30 is charged by the charging station 32 prior to exposure. V is the surface potential of the photoconductor after an exposure E at the exposing station 34. The parameters c and d are dimensionless. The units of b are the reciprocal of the units of exposure—typically $cm^2$/erg. The dynamic range of the photoconductor 30 is proportional to 1/c.

The value of c is independent of $V_0$. The value of b decreases with increasing $V_0$ according to a power function of $V_0$, and d decreases linearly with increasing $V_0$. The equations for these changes from their reference values, $b_r$ and $d_r$, are:

$$b=b_r*(V_0/V_{0r})^{-p} \quad (2)$$

and $$d=d_r-m*(V_0-V_{0r}) \quad (3)$$

$V_{0r}$ is the reference value of $V_0$, which is typically 500 V. Equations 2 and 3 demonstrate the dependences of b and d on $V_0$. Because of these dependences, a change in the primary charge, $V_0$, will result in a change in both the intrinsic sensitivity, b, and the intrinsic toe, d, of the photoconductor 30. The parameters p and m may be referred to as the power dependence of the intrinsic sensitivity on $V_0$, and the linear dependence of the intrinsic toe on $V_0$, respectively.

Accordingly, given equations 1–3 and values for the five parameters $b_r$, c, $d_r$, p and m of the photoconductor 30, the complete photodischarge can be calculated as a function of exposure, E, at any $V_0$. Typically, such predictions of V differ from the experimental values by about 1% of the value of $V_0$.

For a discharged area development (DAD) process, the difference between $V_0$ and the electrical potential of the developing station, $V_{bias}$, is the background potential, BP, or offset, and the difference between $V_{bias}$ and the surface potential, V, of the photoconductor 30 after exposure is the toning potential, TP. Thus, the toning potential is defined by the equation:

$$TP=V_{bias}-V \tag{4}$$

Figure 3:
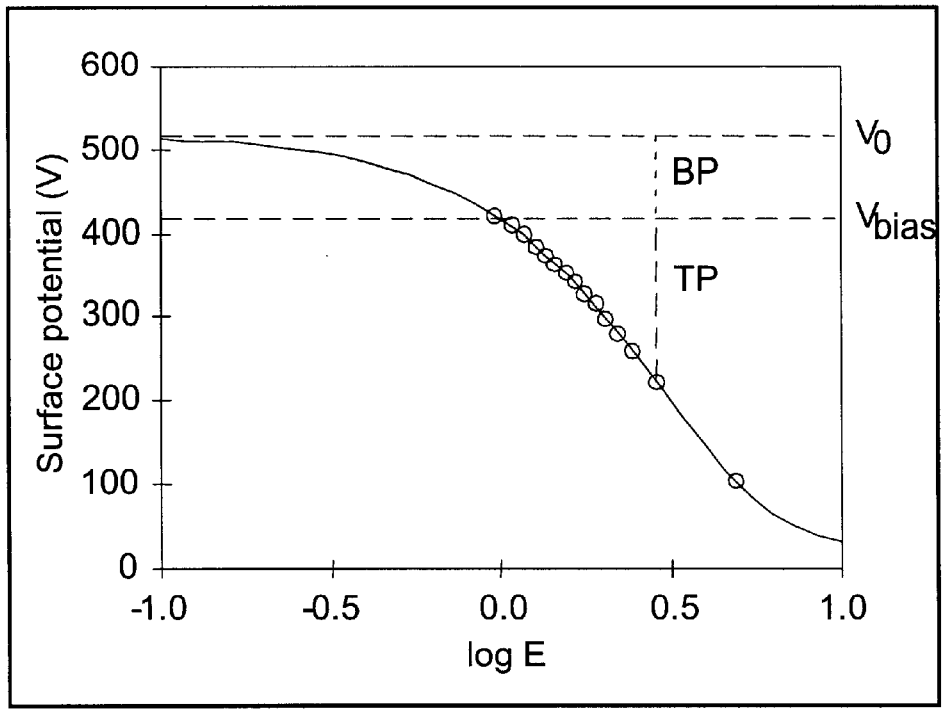
FIG. 3 shows a graph of exposed photoconductor surface potential versus the logarithm of the exposure used to produce that surface potential.

The toning potential is what attracts the charged marking particles from the developing station 36 to the photoconductor 30. In a DAD process, a higher exposure E produces a lower surface potential, V, after exposure, which results in a higher toning potential, TP. FIG. 3 illustrates the toning potential in a DAD process. The background potential, BP, is shown as the difference between $V_0$ and $V_{bias}$. The toning potential, TP, is shown as the difference between $V_{bias}$ and the surface potential, V, produced by a particular exposure, E. For surface potentials that are less than $V_{bias}$, the toning potential, and therefore the amount of marking particles attracted to a particular area of the photoconductor, both increase with decreasing surface potential, V. As FIG. 3 indicates, a relatively small number of marking particles are attracted from the developing station 36 to the photoconductor 30 even when the photoconductor surface potential is slightly higher than $V_{bias}$. It is believed that tribocharging associated with the reproduction apparatus 10 causes this phenomenon, which occurs only within a limited voltage range above $V_{bias}$.

The perceived lightness, L*, of an image on a receiver ranges from 100 to 0. A decease in L* of 5 will appear the same whether it is from 85 to 80 or from 35 to 30. Equation 5 describes the lightness, L*, of an exposed area as a function of toning potential, TP.

$$L^*=w^*\lfloor(1-z)^*\exp(-((TP+x)/h)^y)+z\rfloor \tag{5}$$

Figure 4:
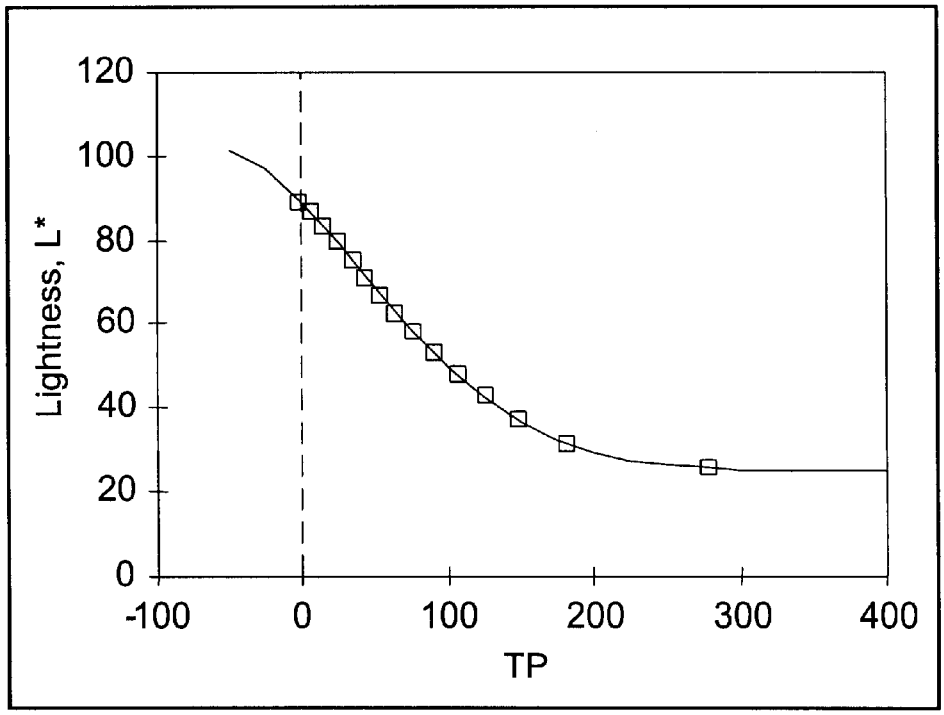
FIG. 4 shows a graph of the lightness of an image developed on a receiver versus the toning potential used to produce that lightness.

FIG. 4 illustrates the relationship between lightness, L*, and toning potential, TP. The parameter w is the maximum lightness of the equation. The product of w and x approximates the minimum lightness that the developed image asymptotically approaches at very high toning potentials. The parameter x approximates an electrical potential offset. This offset is required because of the triboelectric effects that allow toning to occur at photoconductor surface potentials up to x volts above $V_{bias}$, despite the fact that the toning potential is negative. At photoconductor surface potentials greater than $V_{bias}$ plus x volts, toning does not occur. A typical value of x is approximately 40 V. The parameter h is a marking particle charge factor that increases with the increasing ratio of charge to mass (Q/m) of the marking particles. As h increases, more toning potential is required to produce the same density in a developed image. The parameter y is a shaping constant that determines the degree of s-shape of the roughly exponential curve of L versus TP.

The discussion above demonstrates that the lightness, or lensity in color processes, of a developed image is determined by the toning potential irrespective of the $V_0$ to which the photoconductor 30 is charged before exposure. Variations in the sensitometry of the photoconductor, however, frequently cause changes in the toning potential, which affects the lightness or lensity of a developed image. Color images are particularly sensitive to these sensitometric variations. The present invention enables adjustment of the process control parameters $V_0$ and $E_0$ to maintain a constant relationship between the toning potential and a given exposure step even when the sensitometry of the photoconductor varies.

Methods of Measuring Intrinsic Sensitivity and Toe

Before correcting for variations in photoconductor sensitometry, there must be an exact measurement of the separable independent parameters, namely the intrinsic sensitivity or speed, b, the intrinsic contrast, c, and the intrinsic toe, d. These are needed to calculate an exact correction for any variations. Since equation 1 cannot be made linear, it must be solved by successive approximation. The values of b, c, and d must be varied until the combination that minimizes the error between experimental and calculated values for a series of points in the photodischarge curve is found. At a bare minimum, there must be three points in the photodischarge curve, but eight or more points are preferable. Successive approximations are very difficult to carry out on typical electrophotographic reproduction apparatus. However, once c is determined using successive approximation, other methods can be used to determine b and d. This is because it is possible to manufacture photoconductors according to strict contrast specifications. Accordingly, c either remains constant or can be set constant with a negligible loss in the accuracy of the photodischarge equation.

One way to precisely measure the intrinsic toe, d, is to expose the photoconductor 30 with one extremely high exposure. At a very high exposure, the exposed surface potential, V, of the photoconductor 30 approaches its lower limits, and $V/V_0$ approaches the value of the intrinsic toe, d. The intrinsic sensitivity, b, may then be determined by exposing the photoconductor to a series of exposures that discharge the photoconductor 30 to surface potentials in the middle of the voltage range to determine the surface potential, V, that satisfies the following equation:

$$V=V_0^*(1-d)/e+d \tag{6}$$

At this surface potential, the exponential term in equation 1 is exp(−1) or 1/e, regardless of the value of c, and the product of b and E is equal to one. Accordingly, b is equal to the reciprocal of the exposure that produces this critical exposed surface potential on the photoconductor 30.

This approach is limited, however, in that it requires one very large exposure, which is rarely available with LED or laser exposing elements. This method also requires a series of exposures to identify the surface potential that facilitates solving for the intrinsic sensitivity. Finally, this approach requires an algorithm that matches surface potential values, rather than a calculation from a single measurement.

Another approach to determining the intrinsic sensitivity, b, and the intrinsic toe, d, is by inversion of the photodischarge equation (equation 1). The value of c, which typically does not vary significantly, must be known from a previous measurement of the entire photodischarge curve and successive approximation as described above. Using a single very high exposure, as described above, d can be approximated to be the resulting value of $V/V_0$. This approximation of d is then used in an inverted form of equation 1 to calculate b. The inverse of equation 1 is $$E = \left(-\ln\left(\frac{V/V_0 - d}{1-d}\right)\right)^{1/c} \Big/ b \tag{7}$$

Multiplying equation 6 by b/E yields the variation $$b = \left(-\ln\left(\frac{V/V_0 - d}{1-d}\right)\right)^{1/c} \Big/ E \tag{8}$$

Because E is known, d is approximately known, and V can be measured, the intrinsic sensitivity, b, can be calculated. This method of calculating b and d is also limited, however, in that it requires one very large exposure, which is rarely available with LED or laser exposing elements. In addition, equation 7 is a transcendental equation. Solving such transcendental equations requires more time than is typically available in high-speed electrophotographic recording apparatus, which require calculations to run at extremely high speed.

A Simple Linear Calculation of b and d from Two Voltages

The present invention provides a method of deriving two simple linear equations that, given two sample measured exposed surface potentials, allow for accurately determining the sensitivity and toe of the photoconductor at any given time. Again, the value of c, which typically does not vary significantly, must be known from a previous measurement of the entire photodischarge curve and successive approximation as described above. Because c does not change, two linear equations for determining b and d can be derived from equation 1, a plurality of random values for b and d, and successive approximation. These linear equations allow for calculation of b and d precisely over a useful range from the measured voltages $V_1$ and $V_2$ that result from two carefully selected exposures $E_1$ and $E_2$.

Figure 5:
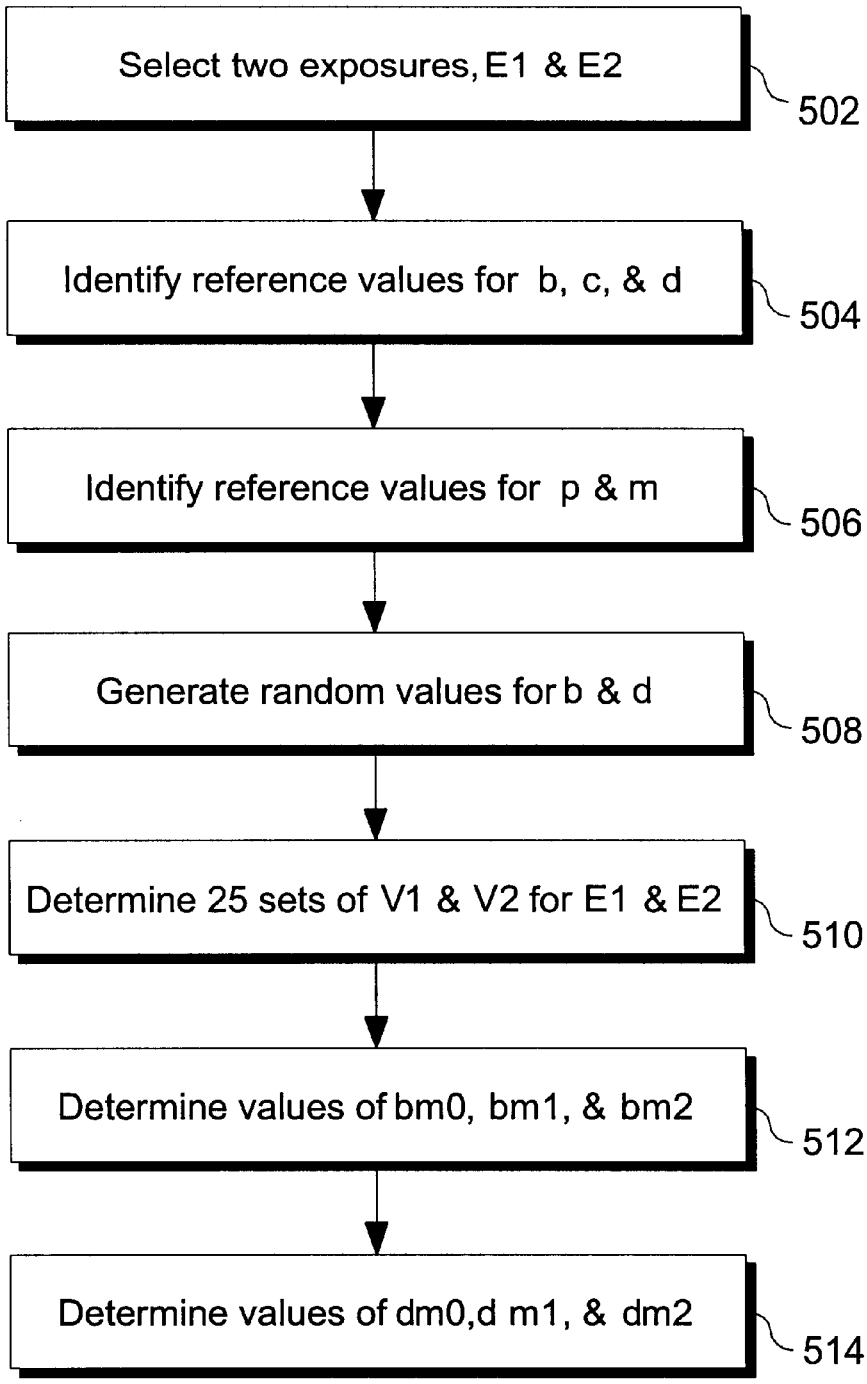
FIG. 5 shows a flow diagram illustrating a method of determining two linear equations for calculating measured values of the intrinsic sensitivity and the intrinsic toe associated with a photoconductor.

FIG. 5 illustrates the method of deriving the these linear equations. The first step 502 is to select two exposures, $E_1$ and $E_2$. Preferably, $E_1$ is chosen to produce an exposed surface potential, $V_1$, that is approximately equal to one half of the value of $V_0$. The second exposure, $E_2$, preferably is chosen to be as bright as the LED or laser exposing element can easily manage, which produces an exposed surface potential, $V_2$, that is relatively close to the intrinsic toe. The next step 504 is to identify reference values for b, c, and d for a $V_0$ of approximately 500 V. These reference values are unique to a particular design and type of photoconductor, and preferably are determined using experimental data collected from a plurality of representative photoconductors. Reference values for p and m are then determined in a similar manner for a range $V_0$ values in step 506. Next, a plurality of random values for b and d are generated in step 508. Preferably, twenty-five random values are generated for both b and d around their reference values. The random values for b preferably are chosen to be between 0.457 $cm^2$/erg and 0.619 $cm^2$/erg. The random values for d preferably are chosen to be between 0.017 and 0.260.

In step 510, for each of the twenty-five random pairs of b and d, equation 1 is used to determine $V_1$ and $V_2$ for exposures $E_1$ and $E_2$. A value of 500 V is used for $V_0$ for purposes of these calculations. Again, $E_1$ preferably is chosen to produce a $V_1$ of approximately 250 V with a nominal b of approximately 0.538 $cm^2$/erg. $E_2$ is chosen to be a relatively high exposure that can easily be delivered by the exposing element. The sensitivity that is measured for a particular type of photoconductor is defined as $b_m$. If $b_m$ is defined as a linear function of both $V_1$ and $V_2$, then it can be described by the equation:

$$b_m = b_{m0} + b_{m1} * V_1 + b_{m2} * V_2 \tag{9}$$

The values of constants $b_{m0}$, $b_{m1}$, and $b_{m2}$ are determined in step 512 by varying them in a successive approximation that minimizes the variance between the twenty-five random values of b generated in step 508 and twenty-five values of $b_m$ that are calculated using equation 9 with the values of $V_1$ and $V_2$ calculated in step 510 using the transcendental equation 1.

In like manner, the toe that is measured for a particular type of photoconductor is defined as $d_m$. If $d_m$ is defined as a linear function of both $V_1$ and $V_2$, then it can be described by the equation:

$$d_m = d_{m0} + d_{m1} * V_1 + d_{m2} * V_2 \tag{10}$$

The values of constants $d_{m0}$, $d_{m1}$, and $d_{m2}$ are similarly determined in step 514 by varying them in a successive approximation that minimizes the variance between the twenty-five random values of d generated in step 508 and twenty-five values of $d_m$ that are calculated using equation 10 with the values for $V_1$ and $V_2$ calculated in step 510 using the transcendental equation 1.

Correcting for Variations of b and d by Adjusting $V_0$ and $E_0$

The correction for variations in the intrinsic sensitivity, b, and the intrinsic toe, d, can be made with precision by changing the values of $V_0$ and $E_0$. It is not necessary to vary any of the individual exposure steps relative to each other. Accordingly, the value of $E/E_0$ for each step remains the same. A variation in b merely shifts the V versus log(E) curve along the log(E) axis with absolutely no change in the shape of the curve. Thus, if b is increased by a constant factor, for instance 1.25, then decreasing the global exposure, $E_0$, by multiplying it by the reciprocal of the same factor, 1/1.25, corrects for the increase in b.

The correction for a variation in d is more complicated. If d increases, then the toning potential, TP, is decreased. As a correction, TP can be increased by increasing $V_0$. However, because d is itself a function of $V_0$, the determination of a corrective $V_0$ is complex. In addition, the change in $V_0$ causes a change in b which in turn requires additional correction of the global exposure, $E_0$, as described above.

The process of adjusting $V_0$ and $E_0$ to correct for variations in b and d involves determining two corrective parameters $V_{0i}$ and $E_{0l}$. The first corrective parameter, $V_{0l}$, is the value of $V_0$ that corrects for variations in intrinsic toe, d, of the photoconductor 30. One way to identify $V_{0i}$ involves transcendental equations. First, it is necessary to introduce another parameter, the effective voltage, $V_e$. The effective voltage is the difference between $V_{bias}$ and the toe at very high exposures, which is in turn is equal to $V_0$*d. Because $V_{bias}$ is equal to the difference between $V_0$ and the background potential, BP, the effective voltage, $V_e$, can be defined as follows:

$$V_e = V_0 - BP - V_0 * d \tag{11}$$

To correct for variations in the intrinsic toe, d, $V_0$ can be adjusted in such a way as to keep $V_e$ constant and then by changing the global $E_0$ in such a way as to correct for the change in speed, b, induced by the change in $V_0$. However, determining what value of $V_0$ is needed to correct for variations in d is not a simple matter because d is itself a function of $V_0$.

The calculation of $V_{0i}$, the intermediate $V_0$ that corrects for variations in d, begins with a calculation of $b_m$ and $d_m$ at $V_{0s}$ from $V_1$ and $V_2$ using equations 9 and 10. At the standard $V_0$, the standard effective voltage, $V_{es}$, can be calculated from a variation of equation 11:

$$V_{es}V_{0s}-BP-V_{0s}*d_s \tag{12}$$

Then, it is necessary to calculate the value of m', which is the value of m for a d other than dr. Because $d_m$ was measured at $V_{0s}$, $d_m$ is divided by $d_s$ rather than $d_r$.

$$m'=m*d_m/d_s \tag{13}$$

Equation 13 merely states that m', which determines the variation of d with the variation of $V_0$, scales with the value of $d_m$. Equation 11 can then be solved for $V_0$, and the terms made specific for $V_{0i}$ to yield the equation:

$$V_{0i}=BP+V_{ei}+V_{0i}*d_i \tag{14}$$

However, the value of $d_i$ is also a function of $V_{0i}$:

$$d_i=d_m-m'*(V_{0i}-V_{0s}) \tag{15}$$

Substituting the equivalent of $d_i$ in equation 15 for $d_i$ in equation 14 yields the equation:

$$V_{0i}=BP+V_{ei}+V_{0i}*(d_m-m'*(V_{0i}-V_{0s})) \tag{16}$$

Equation 16 is simply a quadratic equation in $V_{0i}$:

$$0=m'*V_{0i}^2+(1-d_m-m'*V_{0s})*V_{0i}+(-BP-V_{ei}) \tag{17}$$

Equation 17 can be solved by the quadratic formula:

$$V_{0i}=\frac{-bee\pm\sqrt{bee^2-4*m'*cee}}{2*m'} \tag{18}$$

with $$bee=1-d_m-m'*V_{0s} \tag{19}$$

and $$cee=-BP-V_{es} \tag{20}$$

Because the effective voltage is to be kept constant, $V_{es}$ replaces $V_{ei}$ in equation 20.

The second corrective parameter, $E_{0i}$, is the value of $E_0$ that corrects for variations in both the intrinsic sensitivity, b, and the intrinsic toe, d, of the photoconductor 30. $E_{0i}$ is calculated using transcendental equations. The calculation of $E_{0i}$ for changes in both b and d is simplified because there is no change in the effective voltage, $V_e$. The equation uses $b_m$ and the value of $V_{0i}$ calculated from $d_m$:

$$E_{0i}=E_{0s}*(b_s/b_m)*(V_{0i}/V_{0s})^P \tag{21}$$

The factor $(b_s/b_m)$ in equation 21 corrects the value of $E_{0s}$ for the variation of b from the standard $b_s$ to $b_m$. The factor $(V_{0i}/V_{0s})^P$ further corrects $E_{0s}$ for the change in b that results from the change of $V_{0s}$ to $V_{0i}$. For example, as $V_{0i}$ increases, the intrinsic sensitivity, b, of the photoconductor decreases according to the power law in equation 2. Accordingly, the corrective global exposure parameter $E_{0i}$ is increased by the factor $(V_{0i}/V_{0s})^P$.

It is possible to calculate $V_{0i}$ and $E_{0i}$ from $b_m$ and $d_m$ using equations 18 through 21. However, as with the calculation of $b_m$ and $d_m$ described above, the use of transcendental equations is typically not feasible in high speed reproduction apparatus. Accordingly, the present invention provides a method of determining two linear equations from which $V_{0i}$ and $E_{0i}$ can be calculated.

A Simple Linear Calculation of $V_{0i}$ and $E_{0i}$ from $b_m$ and $d_m$

The twenty-five random combinations of b and d, can be combined with equations 18 through 21 and linear regression analysis to determine two linear equations from which $V_{0i}$ and $E_{0i}$ can be precisely calculated from $b_m$ and $d_m$.

Figure 6:
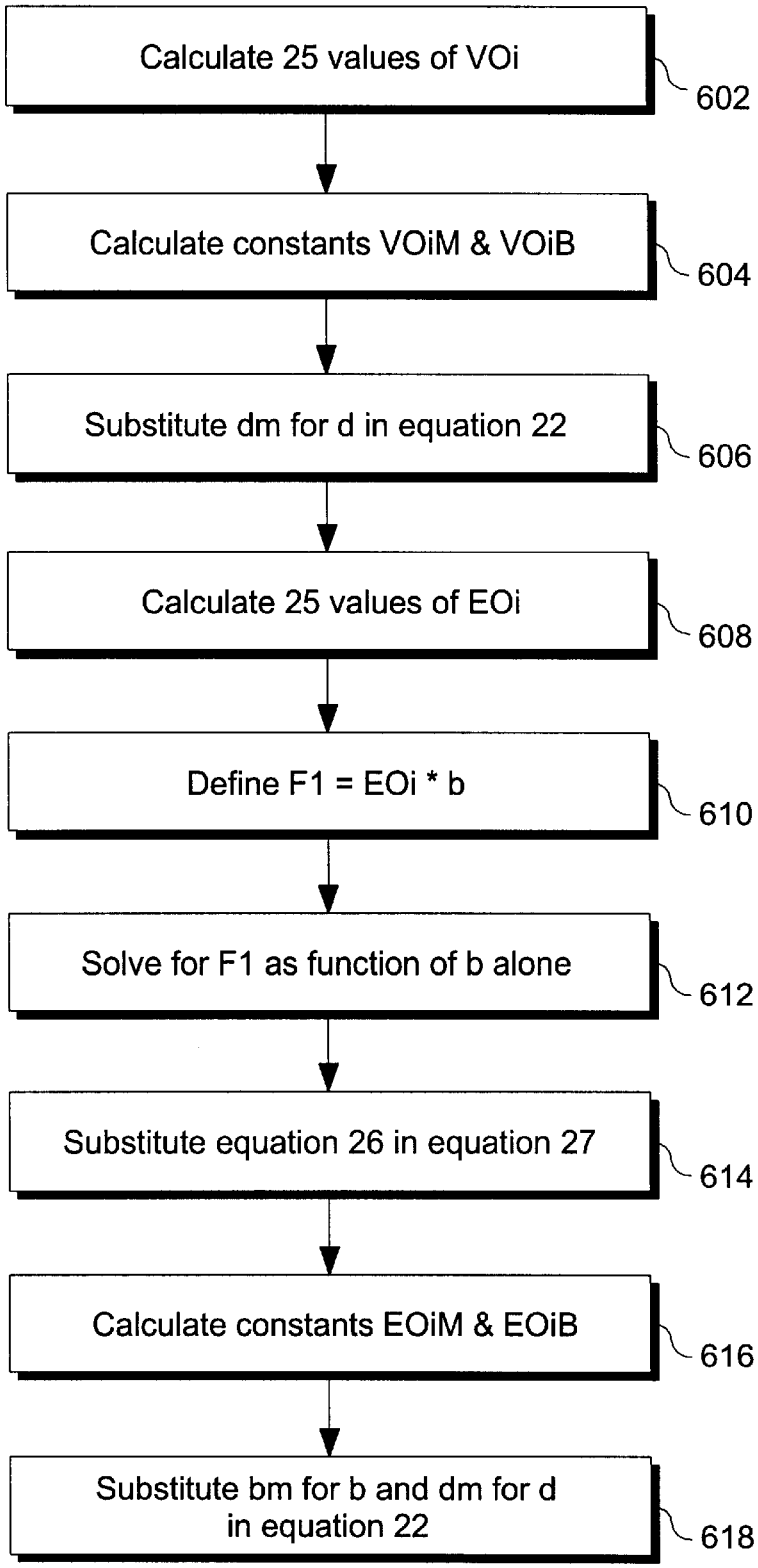
FIG. 6 shows a flow diagram illustrating a method of determining two linear equations for calculating a corrective primary charge parameter and a corrective global exposure parameter.

A method of determining linear equations for $V_{0i}$ and $E_{0i}$ will now be discussed with reference to FIG. 6. The derivation of the linear equation for $V_{0i}$ begins in step 602 with the calculation of twenty-five values of $V_{0i}$ using equations 18 through 20 and the random values of d generated in step 508 of FIG. 5. If $V_{0i}$ is a linear function of d, then it can be described by the equation:

$$V_{0i}=V_{0iM}*d+V_{0iB} \tag{22}$$

Using linear regression, the constants $V_{0iM}$ and $V_{0iB}$ are calculated in step 604. In step 606, $d_m$ is substituted for d to yield a linear relationship between $V_{0i}$ and $d_m$:

$$V_{0i}=V_{0iM}*d_m+V_{0iB} \tag{23}$$

The calculation of $E_{0i}$ is more complex than the calculation of $V_{0i}$. The value of $E_{0i}$ depends on both $b_m$ and $d_m$ because $d_m$ affects $V_{0i}$, which in turn changes the intrinsic speed, b. The calculations are simplified by introducing a parameter $F_1$, which removes b from the linear equation and reintroduces it later. The derivation of the linear equation for $E_{0i}$ begins with the calculation in step 608 of twenty-five values of $E_{0i}$ using a modified version of transcendental equation 21 and the twenty-five random values of b and d generated in step 508 of FIG. 5. The modified transcendental equation is:

$$E_{0i}=E_{0s}*b_s/b*(V_{0i}/V_{0s})^P \tag{24}$$

In step 610, $F_1$ is defined by the equation:

$$F_1=E_{0i}*b \tag{25}$$

Because $F_1$ is the product of b and an equation with b in the denominator, $F_1$ is not in fact a function of b. In step 612, $F_1$ is defined as a function of d alone, according to the following linear equation:

$$F_1=E_{0iM}*d+E_{0iB} \tag{26}$$

A modified version of equation 25 shows that $E_{0i}$ also can be defined as follows:

$$E_{0i}=F_1/b \tag{27}$$

In step 614, equation 26 is substituted in equation 27 to yield:

$$E_{0i}=(E_{0iM}*d+E_{0iB})/b \tag{28}$$

Using linear regression, the constants $E_{0iM}$ and $E_{0iB}$ are calculated in step 616. In step 618, $d_m$ is substituted for d, and $b_m$ is substituted for b to yield a linear relationship between $E_{0t}$ and both $b_m$ and $d_m$:

$$E_{0t}=(E_{0tM}*d_m+E_{0tB})/b_m \quad (29)$$

The linear equations 23 and 29 provide a very accurate means for calculating corrective parameters $V_{0i}$ and $E_{0i}$ using the values for $b_m$ and $d_m$ calculated according to linear equations 9 and 10. Comparison of calculation results from linear and transcendental equations shows that using the linear equations instead of the transcendental equations adds a standard order of estimate of only about 0.2 V, or approximately 0.04% of $V_{0s}$.

Figure 7:
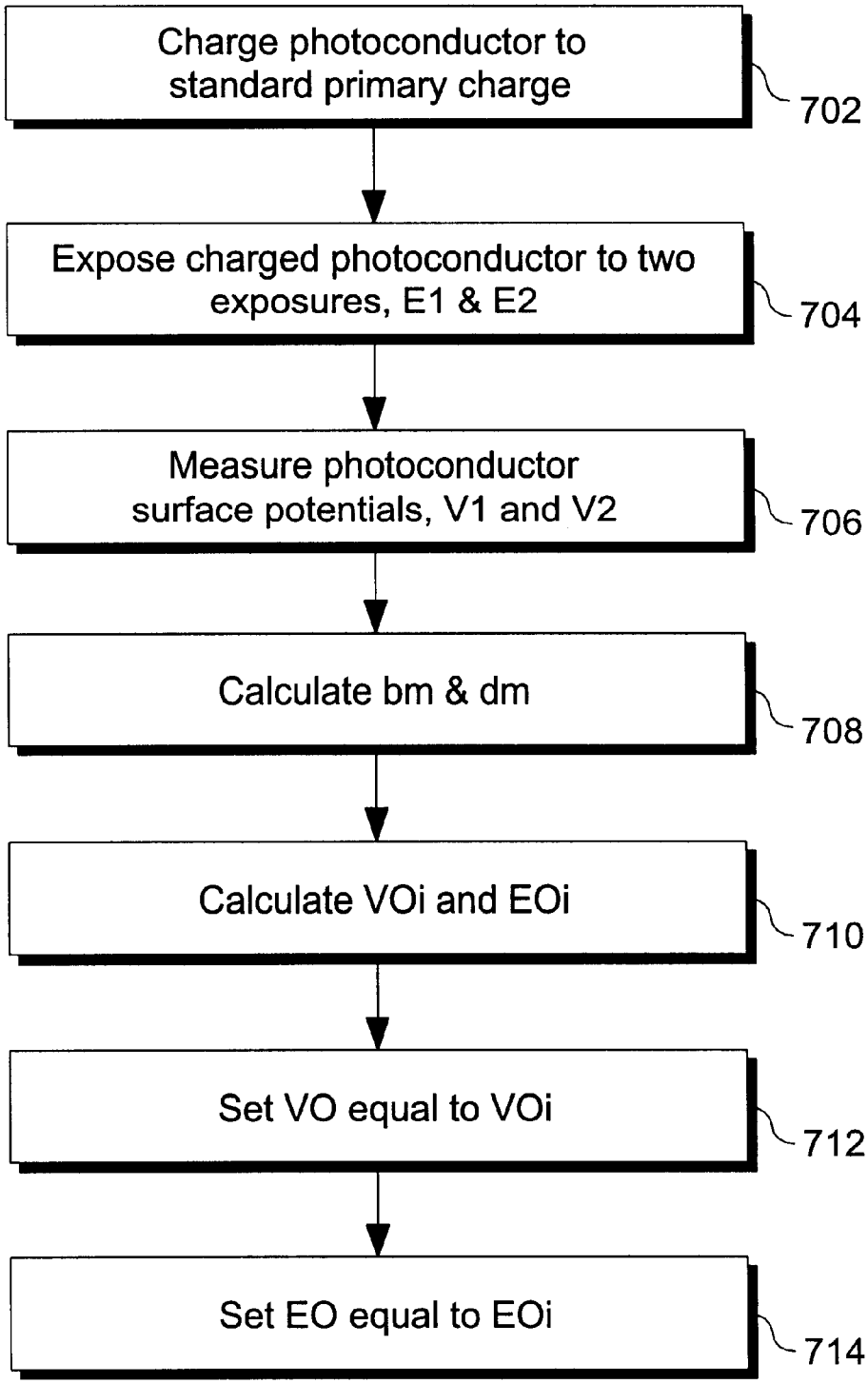
FIG. 7 shows a flow diagram illustrating a process control method for adjusting the primary charge and the global exposure of an imaging module to correct for variations in the intrinsic sensitivity an the intrinsic toe of the photoconductor.

A Process Control Algorithm to Correct for Variation in Photoconductor Sensitometry The derivations of the linear equations 9, 10, 23, and 29 and the ten linear parameters $b_{m0}$, $b_{m1}$, $b_{m2}$, $d_{m0}$, $d_{m1}$, $d_{m2}$, $V_{0iM}$, $V_{0iB}$, $E_{0iM}$, and $E_{0iB}$ that are specified for a given type of photoconductor are somewhat complex and involve transcendental equations. However, once the linear equations for a given type of photoconductor have been derived for a standard $V_0$, the resulting method of correcting for changes in photoconductor operating sensitometry is quite simple. This process control correction method will now be described with reference to FIG. 7.

The method begins with step 702 in which the charging station 32 charges the photoconductor 30 to a standard primary charge $V_{0s}$. The standard primary charge preferably is 500 V. In the next step 704, the exposing station 34 exposes the charged photoconductor 30 to two known test exposures, $E_1$ and $E_2$. The first test exposure, $E_1$, preferably is chosen to produce an exposed photoconductor surface potential of approximately one half the magnitude of $V_{0s}$, or approximately 250 V. The second test exposure, $E_2$, preferably is chosen to be as high as the exposing element can easily manage. After the test exposures, in step 706, the electrometer 48 measures two photoconductor surface potentials, $V_1$ and $V_2$, that result from the test exposures. Then, in step 708, the logic and control unit 12 uses equations 9 and 10 and the two measured surface potentials, $V_1$ and $V_2$, to calculate the operating intrinsic sensitivity, $b_m$, and the operating intrinsic toe, $d_m$, of the photoconductor 30. The logic and control unit 12 then uses equations 23 and 29, the operating intrinsic sensitivity, $b_m$, and the operating intrinsic toe, $d_m$, to calculate the corrective parameters $V_{0i}$ and $E_{0i}$ in step 710. Then, in step 712, the logic and control unit 12 adjusts the primary charge $V_0$ to equal the value of the calculated corrective parameter $V_{0i}$. Finally, in step 714, the logic and control unit 12 adjusts the global exposure $E_0$ to equal the value of the calculated corrective parameter $E_{0i}$.

The invention has been described in detail with particular reference to preferred embodiments thereof, but it will be understood that variations and modifications can be effected within the spirit and scope of the invention as set forth in the claims.

What is claimed is:

1. An electrophotographic reproduction apparatus comprising:

an electrostatic recording member for supporting an electrostatic image;

charging means for establishing a primary charge on the recording member, the primary charge being defined by a charge parameter $V_0$;

exposing means for modulating the primary charge to form an electrostatic image on the recording member and having an exposure parameter $E_0$;

measuring means for measuring an exposed surface potential of the recording member after modulation by the exposing means; and control means for controlling adjustments to the parameters $V_0$ and $E_0$ by directing the charging means to establish a standard primary charge $V_{0s}$ on the recording member; directing the exposing means to modulate the primary charge to form a first electrostatic control patch using a first test exposure level $E_1$ and a second electrostatic control patch using a second test exposure $E_2$, directing the measuring means to measure a first test surface potential $V_1$ of the first control patch and a second test surface potential $V_2$ of the second control patch, calculating a measured intrinsic sensitivity $b_m$ and a measured intrinsic toe $d_m$ associated with the recording member using $V_1$ and $V_2$, calculating a corrective charge parameter $V_{0i}$ using $d_m$, calculating a corrective exposure parameter $E_{0i}$ using $b_m$ and $d_m$, adjusting $V_0$ to equal $V_{0i}$, and adjusting $E_0$ to equal $E_{0i}$.

2. An electrophotographic reproduction apparatus as in claim 1, wherein:

the control means calculates the measured intrinsic sensitivity according to the equation $$b_m=b_{m0}+b_{m1}*V_1+b_{m2}*V_2; \text{ and}$$

the control means calculates the intrinsic toe according to the equation $$d_m=d_{m0}+d_{m1}*V_1+d_{m2}*V_2;$$

wherein $b_{m0}$, $b_{m1}$, $b_{m2}$, $d_{m0}$, $d_{m1}$, and $d_{m2}$ are constants.

3. An electrophotographic reproduction apparatus as in claim 2, wherein:

the control means calculates the corrective charge parameter according to the equation $$V_{0i}=V_{0im}*d_m+V_{0iB}; \text{ and}$$

the control means calculates the corrective exposure parameter according to the equation $$E_{0i}=(E_{0iM}*d_m+E_{0iB})/b_m;$$

wherein $V_{0iM}$, $V_{0iB}$, $E_{0iM}$, and $E_{0iB}$ are constants.

4. A method of controlling an electrophotographic reproduction process by adjusting a primary charge parameter $V_0$ and a global exposure parameter $E_0$, comprising:

charging the surface of an electrostatic recording member in an electrophotographic recording apparatus to a standard primary charge $V_{0s}$;

modulating the standard primary charge on the recording member using a first test exposure $E_1$ to form a first exposed test area, and using a second test exposure $E_2$ to form a second exposed test area;

measuring a first test surface potential $V_1$ in the first exposed test area and a second test surface potential $V_2$ in the second exposed test area;

calculating an intrinsic sensitivity $b_m$ associated with the recording member using $V_1$ and $V_2$;

calculating an intrinsic toe $d_m$ associated with the recording member using $V_1$ and $V_2$;

calculating a corrective charge parameter $V_{0i}$ using $d_m$;

calculating a corrective exposure parameter $E_{0i}$ using $b_m$ and $d_m$;

adjusting $V_0$ to equal $V_{0i}$; and adjusting $E_0$ to equal $E_{0i}$.

5. A method of controlling an electrophotographic reproduction process as in claim 4, wherein:

the intrinsic sensitivity is calculated according to the equation $$b_m=b_{m0}+b_{m1}*V_1+b_{m2}*V_2;\text{ and}$$

the intrinsic toe is calculated according to the equation $$d_m=d_{m0}+d_{m1}*V_1+d_{m2}*V_2;$$

wherein $b_{m0}$, $b_{m1}$, $b_{m2}$, $d_{m0}$, $d_{m1}$, and $d_{m2}$ are constants.

6. A method of controlling an electrophotographic reproduction process as in claim 5, wherein:

the corrective charge parameter is calculated according to the equation $$V_{0i}=V_{0iM}*d_m+V_{0iB};\text{ and}$$

the corrective exposure parameter is calculated according to the equation $$E_{0i}=(E_{0iM}*d_m+E_{0iB})/b_m;$$

wherein $V_{0iM}$, $V_{0iB}$, $E_{0iM}$, and $E_{0iB}$ are constants.

7. A method of determining a linear equation for approximating a measured intrinsic sensitivity, $b_m$, of a photoconductor charged to a primary charge, $V_0$, in an electrophotographic recording apparatus, comprising:

selecting a first exposure $E_1$, and a second exposure, $E_2$;

generating a plurality of random sensitometric pairs, wherein each of the random sensitometric pairs includes a random intrinsic sensitivity, $b_{rand}$, and a random intrinsic toe, $d_{rand}$;

calculating a plurality of surface potential pairs using the plurality of random sensitometric pairs, wherein each of the surface potential pairs includes a first photoconductor surface potential, $V_1$, calculated using the first exposure, $E_1$, and a second photoconductor surface potential, $V_2$, calculated using the second exposure, $E_2$; and successively approximating a set of constants, $b_{m0}$, $b_{m1}$, and $b_{m2}$, by using the plurality of surface potential pairs in the linear equation $b_m=b_{m0}+b_{m1}*V_1+b_{m2}*V_2$, to calculate a plurality of measured intrinsic sensitivities, $b_m$, and by and selecting $b_{m0}$, $b_{m1}$, and $b_{m2}$ to minimize a variance between the plurality of measured intrinsic sensitivities, $b_m$, and the plurality of random intrinsic sensitivities.

8. A method of determining a linear equation for approximating a measured intrinsic sensitivity, $b_m$, as in claim 7, further comprising:

identifying a reference intrinsic contrast, $c_r$; and wherein the plurality of surface potential pairs are calculated using the equations $$V_1=V_0*((1-d_{rand})*\exp(-(b_{rand}*E_1)^{c_r})+d_{rand})$$

and $$V_2=V_0*((1-d_{rand})*\exp(-(b_{rand}*E_2)^{c_r})+d_{rand}).$$

9. A method of determining a linear equation for approximating a measured intrinsic sensitivity, $b_m$, as in claim 7, further comprising:

identifying a reference intrinsic sensitivity, $b_r$, a reference intrinsic contrast, $c_r$, and a reference intrinsic toe, $d_r$; and wherein the first exposure, $E_1$, is selected to produce a value of $V_1$ that is approximately equal to the product, $0.5*V_0$, when $V_1$ is calculated using the equation $$V_1=V_0*((1-d_r)*\exp(-(b_r*E_1)^{c_r})+d_r);\text{ and}$$

wherein the second exposure, $E_2$, is selected to produce a value of $V_2$ that is within approximately 10% of the product, $V_0*d_r$, when $V_2$ is calculated using the equation $$V_2=V_0*((1-d_r)*\exp(-(b_r*E_2)^{c_r})+d_r).$$

10. A method of determining a linear equation for approximating a measured intrinsic sensitivity, $b_m$, as in claim 7, wherein:

the plurality of random sensitometric pairs includes twenty-five or more random sensitometric pairs;

the plurality of surface potential pairs includes twenty-five or more surface potential pairs; and the plurality of measured intrinsic sensitivities includes twenty-five or more measured intrinsic sensitivities.

11. A method of determining a linear equation for approximating a measured intrinsic toe, $d_m$, of a photoconductor charged to a primary charge, $V_0$, in an electrophotographic recording apparatus, comprising:

selecting a first exposure $E_1$, and a second exposure, $E_2$;

determining a plurality of random sensitometric pairs, wherein each of the random sensitometric pairs includes a random intrinsic sensitivity, $b_{rand}$, and a random intrinsic toe, $d_{rand}$;

calculating a plurality of surface potential pairs using the plurality of random sensitometric pairs, wherein each of the surface potential pairs includes a first photoconductor surface potential, $V_1$, calculated using the first exposure, $E_1$, and a second photoconductor surface potential, $V_2$, calculated using the second exposure, $E_2$; and successively approximating a set of constants, $d_{m0}$, $d_{m1}$, and $d_{m2}$, by using the plurality of surface potential pairs in the linear equation $d_m=d_{m0}+d_{m1}*V_1+d_{m2}*V_2$, to calculate a plurality of measured intrinsic toes, $d_m$, and selecting $d_{m0}$, $d_{m1}$, and $d_{m2}$ to minimize a variance between the plurality of measured intrinsic toes, $d_m$, and the plurality of random intrinsic toes.

12. A method of determining a linear equation for approximating a measured intrinsic toe, $d_m$, as in claim 11, further comprising:

identifying a reference intrinsic contrast, $c_r$; and wherein the plurality of surface potential pairs are calculated using the equations $$V_1=V_0*((1-d_{rand})*\exp(-(b_{rand}*E_1)^{c_r})+d_{rand})$$

and $$V_2=V_0*((1-d_{rand})*\exp(-(b_{rand}*E_2)^{c_r})+d_{rand}).$$

13. A method of determining a linear equation for approximating a measured intrinsic toe, $d_m$, as in claim 11, further comprising:

identifying a reference intrinsic sensitivity, $b_r$, a reference intrinsic contrast, $c_r$, and a reference intrinsic toe, $d_r$; and wherein the first exposure, $E_1$, is selected to produce a value of $V_1$ that is approximately equal to the product, $0.5*V_0$, when $V_1$ is calculated using the equation $$V_1=V_0*((1-d_r)*\exp(-(b_r*E_1)^{c_r})+d_r); \text{ and}$$

wherein the second exposure, $E_2$, is selected to produce a value of $V_2$ that is within approximately 10% of the product, $V_0*d_r$, when $V_2$ is calculated using the equation $$V_2=V_0*((1-d_r)*\exp(-(b_r*E_2)^{c_r})+d_r).$$

14. A method of determining a linear equation for approximating a measured intrinsic toe, $d_m$, as in claim 11, wherein:

the plurality of random sensitometric pairs includes twenty-five or more random sensitometric pairs;

the plurality of surface potential pairs includes twenty-five or more surface potential pairs; and the plurality of measured intrinsic toes includes twenty-five or more measured intrinsic toes.

15. A method of determining a linear equation for approximating a corrective charge parameter, $V_{0i}$, for use in an electrophotographic reproduction apparatus, comprising:

generating a plurality of random intrinsic toes, $d_{rand}$;

calculating a plurality of corrective charge parameter values, $V_{0i}$, using the plurality of random intrinsic toes; and using linear regression, the plurality of corrective charge parameter values, and the plurality of random intrinsic toes to calculate the constants $V_{0iM}$ and $V_{0iB}$ in the linear equation $$V_{0i}=V_{0iM}*d_{rand}+V_{0iB}.$$

16. A method of determining a linear equation for approximating a corrective exposure parameter, $E_{0i}$, for use in an electrophotographic reproduction apparatus, comprising:

generating a plurality of random sensitometric pairs, wherein each random sensitometric pair includes a random intrinsic sensitivity, $b_{rand}$, and a random intrinsic toe, $d_{rand}$;

calculating a plurality of corrective exposure parameter values, $E_{0i}$, using the plurality of random sensitometric pairs; and using linear regression, the plurality of corrective charge parameter values, and the plurality of random intrinsic toes to calculate the constants $V_{0iM}$ and $V_{0iB}$ in the linear equation $$E_{0i}=(E_{0iM}*d_{rand}+E_{0iB})/b_{rand}.$$

17. A method of determining an intrinsic operating sensitivity, b, of a photoconductor relative to a primary charge, $V_0$, applied to a photoconductor before exposure in an electrophotographic recording apparatus, comprising:

identifying a reference primary charge, $V_{0r}$;

identifying p, wherein p is a power dependence of the intrinsic sensitivity on the primary charge; and calculating the operating intrinsic sensitivity using the reference primary charge, the power dependence of the intrinsic sensitivity on the primary charge, and the equation $$b=b_r*(V_0/V_{0r})^{-p}.$$

18. A method of determining an intrinsic operating sensitivity, b, of a photoconductor relative to a primary charge, $V_0$, as in claim 17, wherein the reference primary charge, $V_{0r}$, is identified to be 500 volts.

19. A method of determining an intrinsic operating toe, d, of a photoconductor relative to a primary charge, $V_0$, applied to a photoconductor before exposure in an electrophotographic recording apparatus, comprising:

identifying a reference primary charge, $V_{0r}$;

identifying m, wherein m is a linear dependence of the intrinsic toe on the primary charge; and calculating the operating intrinsic toe using the reference primary charge, the linear dependence of the intrinsic toe on the primary charge, and the equation $$d=d_r-m*(V_0-V_{0r}).$$

20. A method of determining an intrinsic operating toe, d, of a photoconductor relative to a primary charge, $V_0$, as in claim 19, wherein the reference primary charge, $V_{0r}$, is identified to be 500 volts.

* * * * *